US005167354A

United States Patent [19]

Cohanfard

[11] Patent Number: 5,167,354

[45] Date of Patent: Dec. 1, 1992

[54] BEVERAGE-CONTAINER CARRIER AND SIPPING ASSEMBLY

[76] Inventor: Bahram Cohanfard, 1031 South Wooster St. #102, Los Angeles, Calif. 90035

[21] Appl. No.: 695,968

[22] Filed: May 6, 1991

[51] Int. Cl.[5] ..... B65D 47/12

[52] U.S. Cl. ..... 224/148; 224/202; 224/257; 215/1 A; 215/229; 220/205

[58] Field of Search ..... 224/148, 202, 252, 224–226, 224/257, 258, 269; 220/703, 705, 707, 709, 710, 711, 713–715, 254; 222/175, 464, 548; 215/1 A, 229, 219, 220

[56] References Cited

U.S. PATENT DOCUMENTS

| | | | |
|---|---|---|---|
| 1,208,728 | 12/1916 | Bartlett et al. | 224/148 |
| 2,372,678 | 4/1945 | McKay | 222/464 X |
| 2,731,751 | 1/1956 | Green | 220/709 X |
| 4,193,518 | 3/1980 | Holmes | 224/148 X |
| 4,244,477 | 1/1981 | Seel | 215/229 |
| 4,350,274 | 9/1982 | Morgan | 224/148 X |
| 4,448,316 | 5/1984 | Hiroshige | 215/1 A |
| 4,579,245 | 4/1986 | Narushko | 220/254 X |
| 4,714,173 | 12/1987 | Ruiz | 220/709 |
| 4,815,999 | 3/1989 | Ayon et al. | 224/148 X |
| 4,852,762 | 8/1989 | Chou-Sheng | 220/709 |
| 4,852,781 | 8/1989 | Shurnick et al. | 224/148 |
| 4,867,358 | 9/1989 | Bennis | 222/148 |
| 4,966,300 | 10/1990 | Coonradt | 220/707 |
| 5,029,719 | 7/1991 | Solomon | 215/229 |
| 5,058,778 | 10/1991 | Weinstein | 222/548 X |
| 5,062,542 | 11/1991 | Morton | 220/254 X |

*Primary Examiner*—Henry J. Recla
*Assistant Examiner*—Casey Jacyna
*Attorney, Agent, or Firm*—Albert O. Cota

[57] ABSTRACT

A beverage-container carrier and sipping assembly (10) that is designed to replace the cap on a conventional bottle-type beverage container (60) or to be diretly attached to the circumferential edge (72) of a sport bottle (71) or an opened beverage can (70). The assembly (10) consists of a dome shaped cover (12,14) that has attached a carrying strap (40) and a straw bore (20) on its upper surface that to accepts a drinking straw (22). The strap can be adjusted to an optimum length to hand carry the cover or to a length that allows the assembly (10) to be placed around a person's neck or shoulders. In either case, the strap (40) is attached to the containers cover (12,14) at points that correspond to the container (60) shoulder or center-of-gravity. Therefore, the container is comfortably balanced and supported when held by the strap (40). A vertically or horizontally oriented handle (50,54) can be added to the cover (12,14) to increase the assembly utility.

4 Claims, 3 Drawing Sheets

BEVERAGE-CONTAINER CARRIER AND SIPPING ASSEMBLY

TECHNICAL FIELD

The invention pertains to the general field of portable beverage containers and more particularly to such a container that provides for the insertion of a drinking straw and that includes a carrying strap that allow hands-free carrying of the container and consumption of the beverage.

BACKGROUND ART

The use of portable beverage containers that include a projecting straw to consume the beverage are disclosed in the prior art. Such containers are used in various environments and situations to provide a convenient method for storing and consuming a liquid beverage. The usefulness of these containers particularly extends to bicyclists, hikers, joggers and others in the pursuit of recreational, athletic and other outdoor activities.

The prior art containers typically disclose a combination container that consists of a compact container body and a corresponding threaded cap. The cap includes provisions to allow a straw to be inserted and may contain a poppet valve having a movable member that moves between an open and closed position to allow or prevent beverage dispensing.

A search of the prior art did not disclose any patents covering a container cover that was especially designed to be attached directly to a conventional bottled beverage container and that included a carrying strap. However, the following U.S. patents were considered related:

| PATENT NO. | INVENTOR | ISSUED |
|---|---|---|
| 4,976,364 | Solomon | 11 December 1990 |
| 4,911,315 | Shrum | 27 March 1990 |
| 4,852,762 | Chou-Sheng | 1 August 1989 |
| 4,448,316 | Hiroshige | 15 May 1984 |

The Solomon patent discloses a cap and screw assembly for use with a water bottle or the like. The cap or screw assembly includes a poppet valve of standard construction in combination with a drinking straw. The assembly is adapted for relatively easy dispensing of substantially the entire contents of the water bottle without requiring bottle inversion. When the poppet valve is open, the contents of the bottle can be drawn by sucking through the straw and further through an outlet port defined by the valve.

The Shrum patent discloses a beverage container formed with a collar about its upper end that receives a lid. The lid has an opening into which is inserted a straw that extends through the lid. The straw includes an accordion hinge for allowing an angular orientation of the straw relative to the lid. A removable straw cap is positionable over the upper terminal end of the straw when the straw is not in use. The lid includes a storage boss that receives and keeps the cap when the straw is in use.

The Chou-Sheng patent discloses a liquid drink container in the form of a canteen which is equipped with a drinking straw. The canteen has a dome-shaped rotatable cover with a hole in one side. The cover may be rotated to a first angular position in which an internal closure member closes the hole with the straw retracted into the cover. Likewise, the cover may be rotated to a second angular position in which the closure member moves away from the hole allowing the straw to project out through the hole. At which time, the liquid in the container can be drawn through the straw and consumed.

The Hiroshige patent discloses a liquid drink container that includes a cap having a capped opening through which a flexible straw can be projected. Upon the removal of the cap from the opening, one end of the straw springs out of the opening by the force of a spring acting on the straw. After the straw is projected, the liquid in the container can be consumed.

DISCLOSURE OF THE INVENTION

The beverage-container carrier and sipping assembly is designed to replace the threaded cap on a conventional bottle-type container, or to be directly attached to the upper circumferential edge of a so-called sport bottle or an opened conventional beverage can. In all designs, the assembly is comprised of a container cover having a straw bore near its upper surface that allows a drinking straw to be inserted. The straw can be of the stretchable type or have an accordion hinge that allows the straw to be flexed while the beverage is being consumed. A retained straw cap that is placed over the end of the straw when the straw is not in use is also available.

The cover also includes a cover carrying strap that is attached to the lower edges of the cover which corresponds to the shoulders or center-of gravity of the bottle. Therefore a proper balance and good container support is achieved when the bottle is held by the strap. The strap has provisions to allow its length to be adjusted to a length best suited for holding the assembly by hand or an optimum length for looping the strap around a person's shoulder or neck. When the assembly is placed around the shoulder or neck, the beverage can be carried without using the hands and if the strap is properly adjusted, the beverage can be consumed hands free.

The container cover that is used with a bottle-type container is in a dome like shape that substantially follows the upper shoulder contour of the beverage bottle. The cover preferably has an upwardly extending projection that includes a set of interior threads that correspond with the exterior threads located on the circular collar of the bottle. Thus when the bottle cap is removed, the contoured cover is screwed into the threaded bottle collar. Additionally, this cover can have a spiral thread on its lower inside perimeter that allows the cover to be attached to a sport bottle or the like.

The cover that is designed to be attached to a beverage can is also preferably in a dome shape that includes on its interior, circumferential, lower end an inwardly extending spiral thread. This thread is designed to allow the cover to be easily and positively attached to the upper circumferential edge of the opened beverage can. The can cover can also be made in two sections: a lower section that attaches to the can as described above, and an upper section that has its lower edge rotatably attached to the upper edge of the lower section. This design configuration allows the upper section, which includes a straw bore, to be aligned with the opened and pouring opening on the can by rotating the upper section. To further enhance the utility of the assembly, the cover can be made with a carrying handle.

In view of the above disclosure, it is the primary object of the beverage-container carrier and sipping assembly to provide a beverage container cover that incorporates a cover carrying strap and a drinking straw; where in one instance, the cover replaces the cap of a conventional bottle and in the other instance, the cap attaches directly to the circumferential edge of a sport bottle or opened beverage can.

In addition to the primary object, it is also an object of the invention to provide an assembly that:

- can be manufactured in a variety of colors and materials,
- can be used on various sizes of beverage bottles and cans,
- is hygienic,
- can be adapted to the premium market,
- is cost effective from both a manufacturers and consumers point of view,
- allows a drink to be consumed without use of the hands,
- reduces occurrence of spills,
- can be used by both adults as well as very young children,
- is reusable,
- is dishwasher safe.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
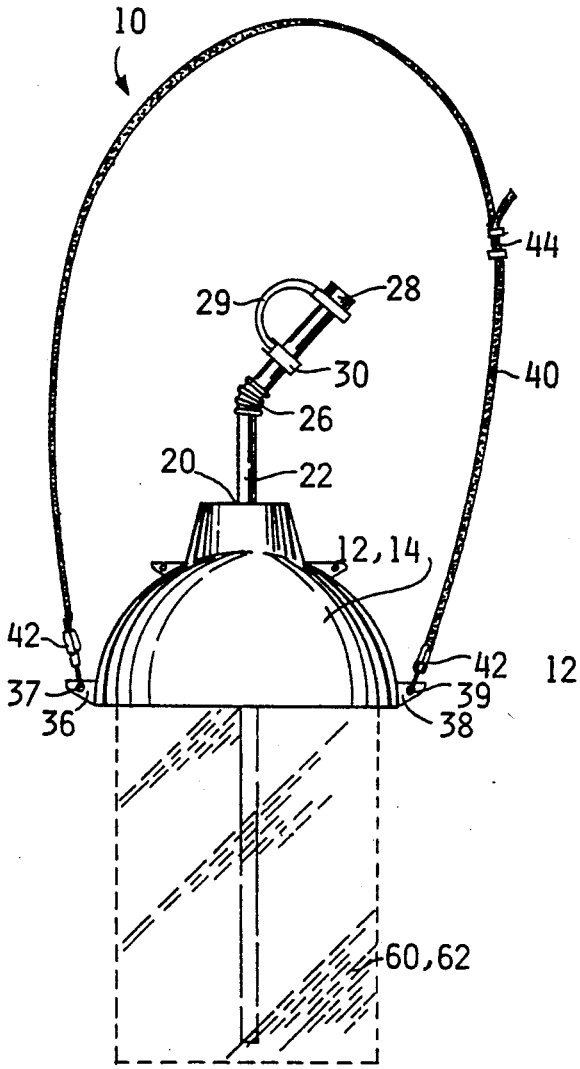
FIG. 1 is a side elevational view of the beverage-container carrier and sipping assembly attached to a bottle-type beverage container and showing the placement of the cover carrying strap and the drinking straw.

The best mode for carrying out the beverage-container carrier and sipping assembly 10 is presented in terms of a preferred embodiment that is presented in two design configurations: in the first design, the assembly replaces the standard cap of a conventional beverage-container 60 such as a 16-ounce (473 ml) or a 33.8-ounce (1 liter) bottle 62; in the second design, the assembly is attached to the top edge of a beverage container such as a 12-fluid ounce (354 ml) can 70 or a so-called sport bottle 71. In either design, the assembly includes a cover that includes a drinking straw and a carrying strap that supports and provides a convenient way to carry the container.

Figure 2:
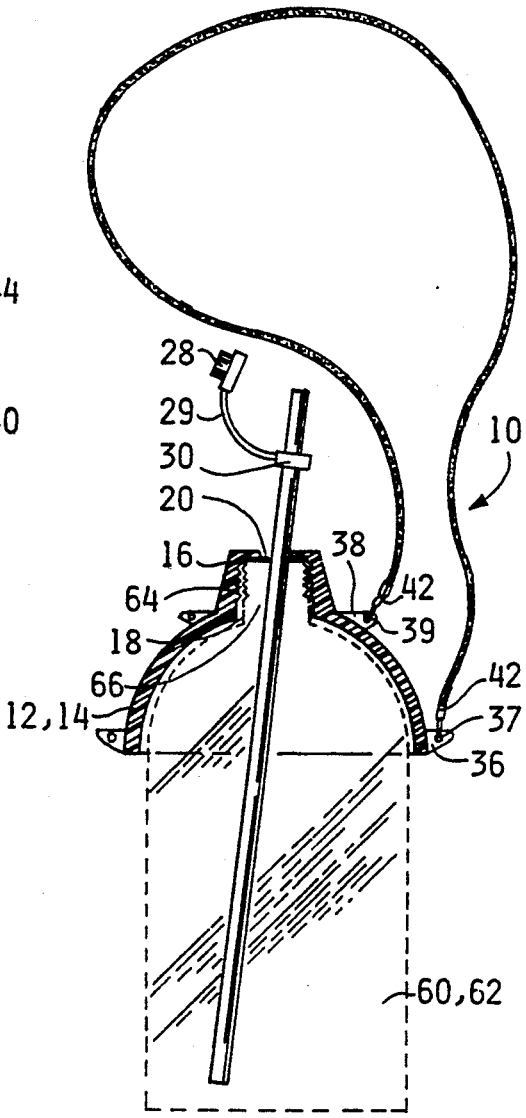
FIG. 2 is a cross-sectional elevational view of the assembly attached to a bottle-type beverage container.
Figure 13:
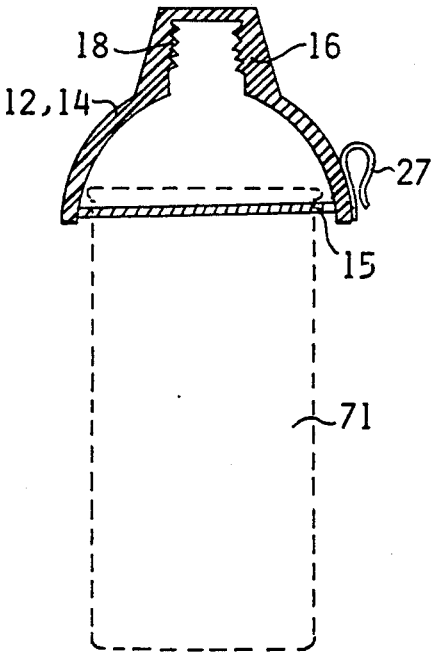
FIG. 13 is a side elevational view of a dome-shaped cover that includes a set of threads on its upper interior, a spiral thread on its lower inside perimeter and a belt clip.
Figure 9:
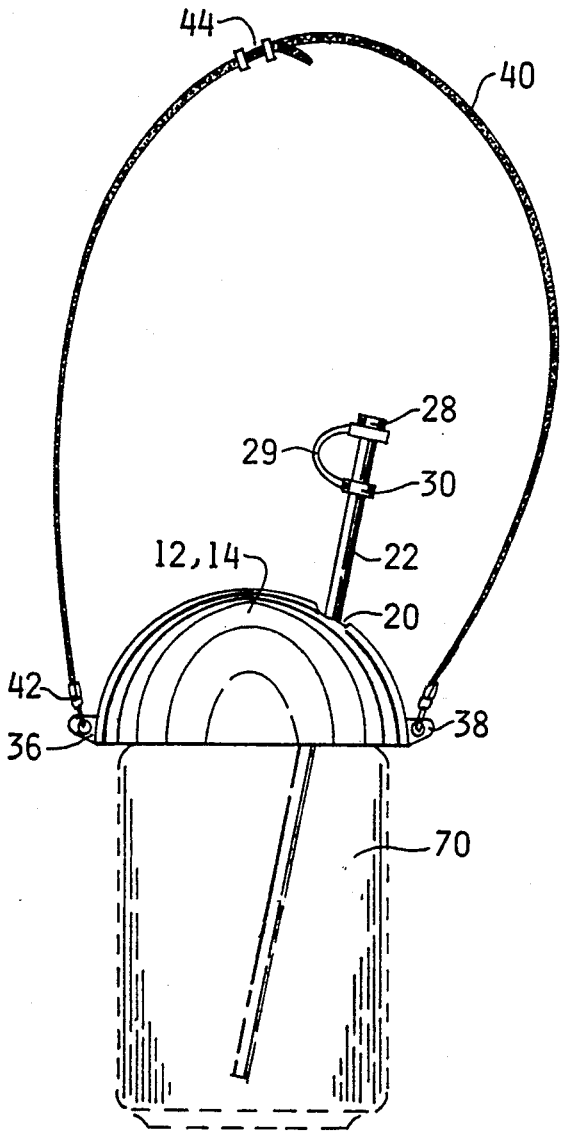
FIG. 9 is a side elevational view of the beverage-container carrier and sipping assembly attached to a beverage can and showing the placement of the cover carrying strap and the drinking straw.

The first design configuration, as shown in FIGS. 1–8, consists of a container cover 12 that has a downwardly extending dome 14 having a shape that substantially follows the upper contour of the beverage bottle 62. On the top of the dome 14 is located an upwardly extending projection 16 that is an integral extension of the dome structure. On the inside of the projection 16, as shown in FIG. 2, are located a set of interior threads 18 that correspond to a set of exterior threads 64 that are located on the collar 66 of the bottle 62. Thus, the corresponding set of threads 18, 64 provide the means by which the container cover 12 can be removably attached to the beverage dispensing end of the bottle 62. A modification to this first design adds a spiral thread 15 to the lower inside perimeter. This thread allows the same container cover 12 to be attached to a sport bottle 71 as shown in FIG. 13.

Figure 5:
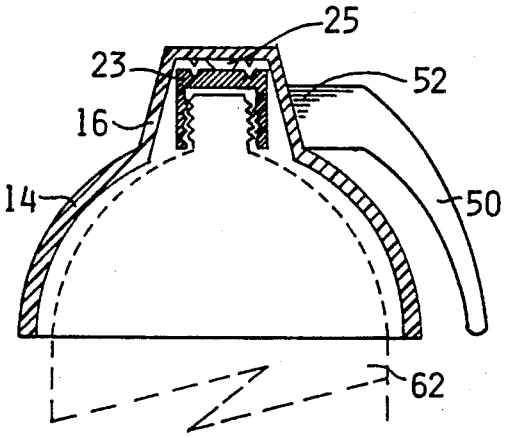
FIG. 5 is a side elevational view of a typical dome-shaped container having an upwardly extending projection having a rotating thread assembly and having attached a vertically oriented open handle.

The projection 16 can also be made with a rotating thread assembly 23 that includes a clutch device 25 as shown in FIG. 5. This assembly allows the cover 12 to rotate without uncapping or removing the cover. To tighten or remove the cover, a downward pressure is applied to the top of the cover to engage and lock the threads by means of the device 25 at which time the cover can be rotated in either direction.

Figure 3:
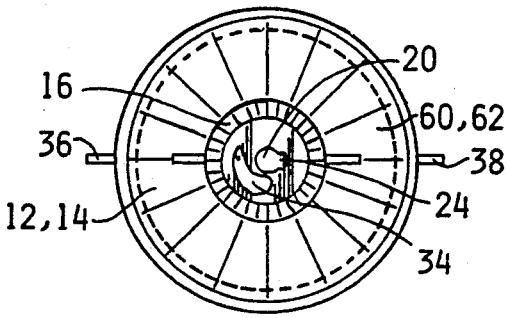
FIG. 3 is top plan view of the assembly.

As also shown in FIGS. 1 and 2, a straw bore 20 is bored on the top end of the dome or preferably at the top of the upwardly extending section 16. The straw bore 20 is substantially centered over the pouring and drinking opening of the bottle 62 and is sized to allow a drinking straw 22 to be frictionally moved in and out of the straw bore 20 as desired by the drinker. On one side of the straw bore 20, as shown in FIG. 3, may be located a straw notch 24. The notch is sized to allow the straw 22, when slightly squeezed, to be inserted into the notch to maintain and hold the straw at a desired elevation as selected by the drinker.

The straw 22 may also include an accordion hinge 26 as shown in FIG. 1, to allow the straw to be flexed while the beverage is being consumed. Additionally, the straw may be equipped with a retained straw cap 28 that is placed over the end of the straw as shown in FIG. 1, when the beverage is not being consumed. The cap includes a longitudinal extension strip 29 that has on its lower end a retaining loop 30. The loop slips over the straw 22 and allows the cap 28 structure to remain attached to the straw when the cap is removed from the straw end as shown in FIG. 2.

Figure 6:
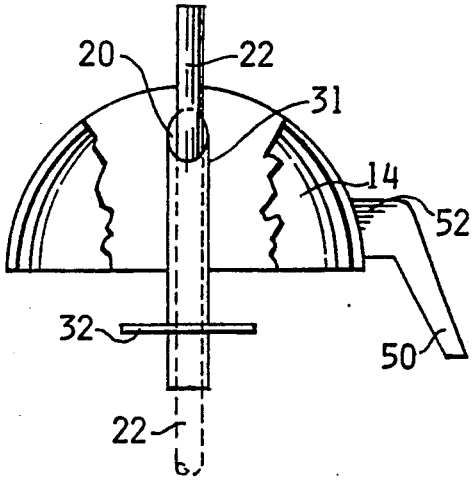
FIG. 6 is a side elevational view of a typical dome-shaped container cover that includes an internal straw sleeve with a cap and having attached a vertically oriented open handle.

The cover 14 for the beverage can 70 can also be made with a straw sleeve 31, as shown in FIG. 6, that has its upper end attached to the straw bore 20 and that has juxtaposed over the beverage can opening 74, a cover 32. The cover 32 is longitudinally positioned on the sleeve to cover and seal the opening 74 to reduce incidents of spilling.

The final disclosed element related to the drinking straw 22 is a sliding straw-bore cap 34. This cap is pivotally attached to the top of the upwardly extending projection 16 near the location of the straw bore 20. When the straw is in use, it is slid to the side as shown in FIG. 3 and is slid over the straw bore 20, (not shown) when a straw is not being used.

Figure 4:
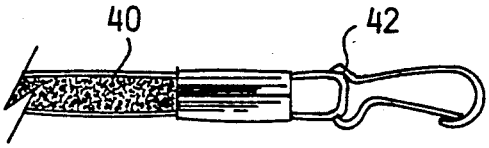
FIG. 4 is a fragmental view showing one end of the carrying strap with its attached safety hook.

The utility of the assembly 10 is greatly enhanced by the inclusion of a cover carrying strap 40 that forms a loop, as shown in FIGS. 1 and 2, that can be hand held or placed around a person's shoulders or neck. The neck and shoulders placement position is especially useful for bicyclists, hikers and other athletic activities. The strap which can be made of any soft flexible material such as cloth, leather or plastic, includes a cover attachment means that preferably consists of a safety hook 42, as shown in FIG. 4, that is attached to each end of the strap. The strap as shown in FIG. 1, may also include a strap length adjusting means that preferably consists of a slide buckle 44 that allows the strap length to be adjusted and locked inplace as desired by the user.

To allow the cover carrying strap 40 to be attached to the container cover 12, the cover is equipped with a first outwardly extending protrusion 36 having a bore 37 therethrough and a second outwardly extending protrusion 38 also having a bore 39 therethrough. The first and second protrusion may be located substantially on opposite sides as shown in FIG. 1 or they may be located on the same side, one below the other, as shown in FIG. 2. In either case, the strap is attached by inserting the safety hooks 42 into the respective bores of the two protrusions as also shown in FIGS. 1 and 2.

Note that the strap attachment point on the horizontal strap attachment scheme, as shown in FIG. 1, and the bottom attachment point on the vertical strap attachment scheme, as shown in FIG. 2, are located near the center-of-gravity or shoulder of the bottle. This arrangement allows the container 62 to be firmly supported and balanced when it is held by the strap 40. Additionally, the one-side attachment scheme allows the container to be A) held and carried without the strap 40 interfering with the straw 22 and B) set at a more convenient angle to grasp the container and drink from it.

Figure 7:
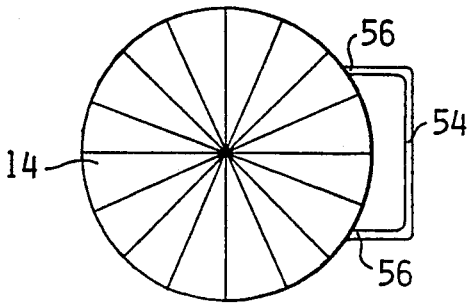
FIG. 7 is a top plan view of a typical container cover having attached a horizontal oriented closed looped handle.
Figure 8:
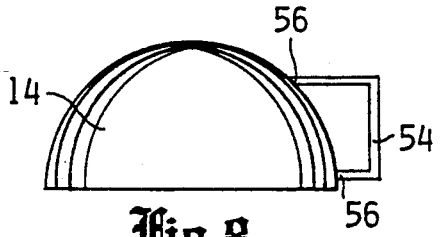
FIG. 8 is a side elevational view of a typical container cover having attached a vertically oriented closed looped handle.

To further enhance the cover utility, the cover 14 can include a cover holding means. In one design, the means consists of a vertically oriented open handle 50 that has its upper end 52 attached to the cover 14 as shown in FIG. 6 or attached to the upwardly extending projection 16 as shown in FIG. 5. A second design consists of a closed looped handle 54 having two attachment ends 56. The handle may be attached to the cover 14 in a horizontal orientation as shown in FIG. 7 or in a vertical orientation as shown in FIG. 8.

Figure 10:
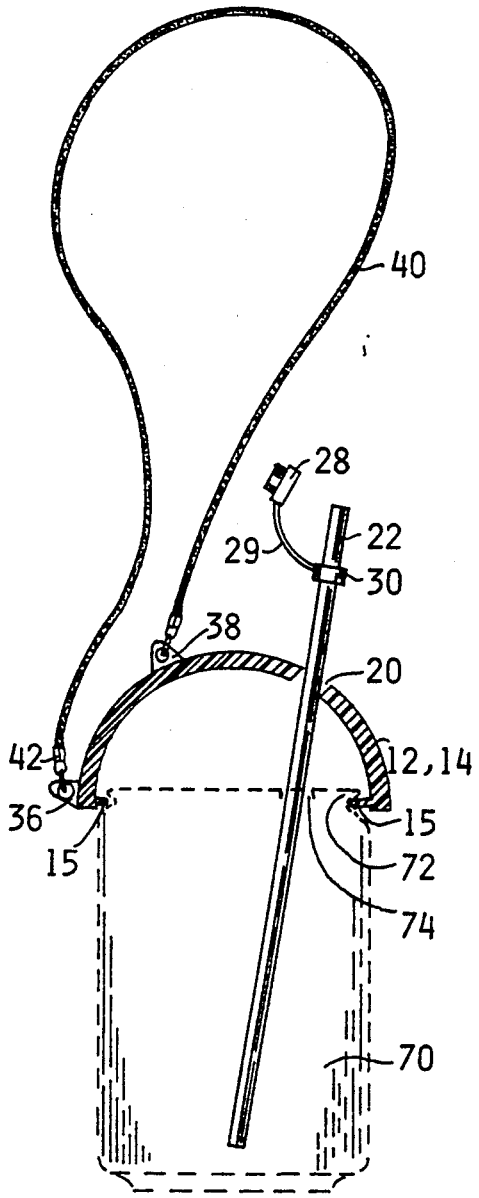
FIG. 10 is a cross-sectional elevational view of the assembly attached to a beverage can.

The second configuration of the beverage-container carrier and sipping assembly 10 is designed to be used in combination with a conventional beverage can 70 as shown in FIGS. 4, 6–12. In this design, the container cover has means for removably attaching the cover to the upper circumferential edge 72 of the can 70. The preferred cover-can attachment means utilizes a container cover 12 that is shaped as a downwardly extending dome 14. The dome includes on its interior, circumferential, lower end an inwardly extending spiral thread 15, as shown in FIG. 10, that provides the means for rotatably attaching the dome-shaped container cover 12 to the upper circumferential edge 72 of the can 70.

Figure 11:
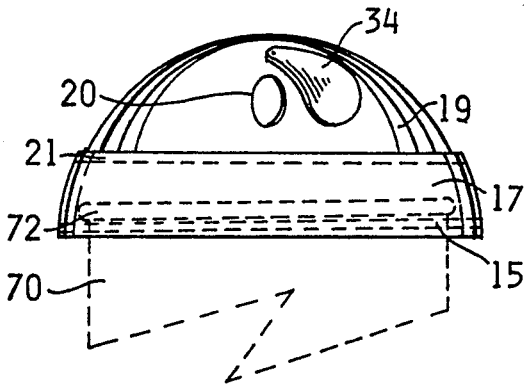
FIG. 11 is a side elevational view of a dome-shaped cover that is made with a lower section that attaches to a beverage can and an upper section that rotates about the lower section.

A modification to the container cover of the second design configuration is comprised of a horizontally divided lower section 17 and an upper section 19 as shown in FIG. 11. In this design, the lower section 17 includes on its interior, circumferential lower end the inwardly extending spiral thread 15 that allows the cover to be attached to the can 70. The upper section 19 has on its perimeter a means 21 for attaching and freely rotating the upper section with respect to the stationary lower section 17. Thus allowing the straw bore 20 to be aligned with the opened and pouring drinking opening of the can 70 by simply rotating the upper section 19.

Figure 12:
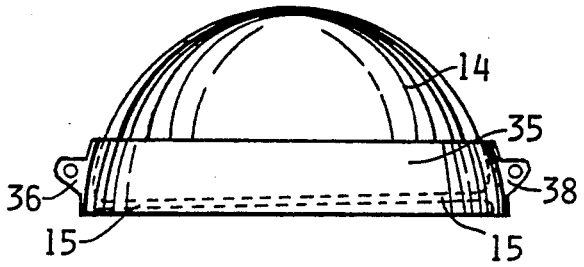
FIG. 12 is a side elevational view of a dome-shaped cover that includes a rotatable security band.

An additional modification to the container cover can also be made by having a security band 35 that encircles and is rotatably attached, by an attaching means, to the lower circumferential side of the cover as shown in FIG. 12. The band 35 includes an internal spiral thread 15 at its lower edge. This thread can be attached to the upper circumferential edge 72 of the beverage can 70 or to a protruding edge (not shown) located on the lower circumferential edge of the band 35. In either case, the band provides additional attachment security. Also, the cover can include a belt clip that is attached to the cover as shown in FIG. 13. The clip allows the cover to be conveniently carried by attaching the clip to a belt or pocket edge.

Many of the implements described for the first design configuration are also applicable for use with the second design configuration. These implements include: A) the cover carrying strap 40 that is attached to the cover by means of the straps safety hooks 42 that, in turn, attach to the upwardly extending projections 16; B) the sipping straw 22 and its related straw bore 20, notch 24, accordion hinge 26 and retained straw cap 28; and C) the two cover holding means consisting of a vertically oriented open handle 50 and a closed looped handle 54.

While the invention has been described in complete detail and pictorially shown in the accompanying drawings it is not to be limited to such details, since many changes and modifications may be made to the invention without departing from the spirit and the scope thereof. For example, the cover can be designed to fit various sizes and shapes of bottled beverages, various types and sizes of beverage cans and can be made of various material such as metal, wood or plastic. Hence, it is described to cover any and all modifications and forms which may come within the language and scope of the claims.

I claim:

1. A beverage-container carrier and sipping assembly designed to replace the standard lid of a conventional beverage container, said assembly comprising:

a) a container cover that is removably attached to the opened beverage dispensing end of the container, where the container consists of a bottle having at its upper terminal end a circular collar that includes a set of exterior threads, where said container cover has a downwardly extending dome shape that substantially follows the upper contour of said bottle container and has an upwardly extending projection that includes a corresponding set of interior threads that provide the means for removably attaching said cover to the beverage dispensing end of the bottle, said cover further having a straw bore therethrough that is substantially centered over the pouring and drinking opening on the container and that is sized to allow a drinking straw to frictionally move in and out of said straw bore, and b) a cover carrying strap having one end attached, by an attachment means to one side of said cover and the other end to a second side of said cover, where said strap forms a loop that can be held or placed around a person's shoulders or neck, and where said strap attachment point is located near the shoulder or center-of-gravity of the container so that the container is supported and balanced when held by said strap.

2. A beverage-container cover and sipping assembly designed to replace the standard lid of a conventional beverage container, said assembly comprising:

a) a container cover that is removably attached to the opened beverage dispensing end of the container, where the container consists of a bottle having at its upper terminal end a circular collar that includes a set of exterior threads, where said container cover has a downwardly extending dome shape that substantially follows the upper contour of said bottle container and has an upwardly extending projection that includes a corresponding set of interior threads that provide the means for removably attaching said cover to the beverage dispensing end of the bottle, said container cover further comprising a spiral thread located on the lower inside perimeter of said cover, where said spiral thread allows said cover to also be attached to a sport bottle, with said cover further having a straw bore therethrough that is substantially centered over the pouring and drinking opening on the container and that is sized to allow a drinking straw to frictionally move in and out of said straw bore.

3. A beverage-container carrier and sipping assembly designed to replace the standard lid of a conventional beverage container, said assembly comprising:

a) a container cover that is removably attached to the opened beverage dispensing end of the container, where the container consists of a bottle having at its upper terminal end a circular collar that includes a set of exterior threads, where said container cover has a downwardly extending dome shape that substantially follows the upper contour of said bottle container and has an upwardly extending projection that includes a corresponding set of interior threads that provide the means for removably attaching said cover to the beverage dispensing end of the bottle, said cover further having a straw bore therethrough that is substantially centered over the pouring and drinking opening on the container and that is sized to allow a drinking straw to frictionally move in and out of said straw bore, and b) a first outwardly extending protrusion having a bore therethrough is located on the same side and below a second outwardly extending protrusion also having a bore therethrough, where a cover carrying strap having one end is attached to the bore on said first outwardly extending protrusion by an attachment means and the other end of said strap is attached to the bore on said second outwardly extending protrusion, where said strap attachment point is located near the shoulder or center-of-gravity of the container so that the container is supported and balanced when held by said strap.

4. A beverage-container carrier and sipping assembly designed to replace the standard lid of a conventional beverage container, said assembly comprising:

a) a container cover that is removably attached to the opened beverage dispensing end of the container, where the container consists of a bottle having at its upper terminal end a circular collar that includes a set of exterior threads, where said container cover has a downwardly extending dome shape that substantially follows the upper contour of said bottle container and has an upwardly extending projection that includes a corresponding set of interior threads that provide the means for removably attaching said cover to the beverage dispensing end of the bottle and that also includes a rotating thread assembly having a clutch device, where said assembly allows said cover to rotate without uncapping or removing the cover and where said cover can be tightened or removed by applying a downward pressure to the top of the cover to engage and lock the threads by means of said clutch device, said cover further having a straw bore therethrough that is substantially centered over the pouring and drinking opening on the container and that is sized to allow a drinking straw to frictionally move in and out of said straw bore, and b) a cover carrying strap having one end attached, by an attachment means to one side of said cover and the other end to a second side of said cover, where said strap forms a loop that can be held or placed around a person's shoulders or neck, and where said strap attachment point is located near the shoulder or center-of-gravity of the container so that the container is supported and balanced when held by said strap.

* * * * *